US008965676B2

(12) United States Patent
Hafner et al.

(10) Patent No.: US 8,965,676 B2
(45) Date of Patent: Feb. 24, 2015

(54) COMPUTATIONALLY EFFICIENT INTERSECTION COLLISION AVOIDANCE SYSTEM

(75) Inventors: Michael Robert Hafner, Ann Arbor, MI (US); Drew Cunningham, Ypsilanti Township, MI (US); Lorenzo Caminiti, Ann Arbor, MI (US); Domitilla Del Vecchio, Somerville, MA (US)

(73) Assignees: Toyota Motor Engineering & Manufacturing North America, Inc., Erlanger, KY (US); The Regents of the University of Michigan, Ann Arbor, MI (US)

( * ) Notice: Subject to any disclaimer, the term of this patent is extended or adjusted under 35 U.S.C. 154(b) by 223 days.

(21) Appl. No.: 13/548,378

(22) Filed: Jul. 13, 2012

(65) Prior Publication Data

US 2012/0330542 A1 Dec. 27, 2012

Related U.S. Application Data

(63) Continuation-in-part of application No. 12/796,978, filed on Jun. 9, 2010, now Pat. No. 8,639,437.

(51) Int. Cl.
*G08G 1/16* (2006.01)

(52) U.S. Cl.
CPC ..... *G08G 1/163* (2013.01)
USPC ..... 701/301; 701/117; 340/907

(58) Field of Classification Search
CPC ..... G01S 13/93; G01S 13/931; G08G 1/16; G08G 1/161; G08G 1/163; G08G 1/166; B60W 30/09; B60W 30/08; B60W 30/095; B60W 30/0953; B60W 30/0956
USPC ..... 701/301, 117; 340/907
See application file for complete search history.

(56) References Cited

U.S. PATENT DOCUMENTS

| | | | | |
|---|---|---|---|---|
| 5,652,705 | A * | 7/1997 | Spiess | 701/117 |
| 5,907,293 | A * | 5/1999 | Tognazzini | 340/903 |
| 5,939,976 | A * | 8/1999 | Sasaki et al. | 340/435 |
| 6,450,132 | B1 * | 9/2002 | Yao et al. | 122/366 |
| 6,791,471 | B2 * | 9/2004 | Wehner et al. | 340/903 |
| 7,295,925 | B2 * | 11/2007 | Breed et al. | 701/301 |
| 2002/0198660 | A1 * | 12/2002 | Lutter et al. | 701/301 |
| 2003/0006889 | A1 * | 1/2003 | Koike | 340/435 |
| 2008/0125972 | A1 * | 5/2008 | Neff | 701/300 |
| 2008/0133136 | A1 * | 6/2008 | Breed et al. | 701/301 |
| 2008/0167821 | A1 * | 7/2008 | Breed | 701/301 |
| 2009/0033540 | A1 * | 2/2009 | Breed et al. | 342/29 |
| 2009/0234552 | A1 * | 9/2009 | Takeda et al. | 701/96 |
| 2010/0045482 | A1 * | 2/2010 | Strauss | 340/903 |
| 2010/0169009 | A1 * | 7/2010 | Breed et al. | 701/208 |
| 2011/0106442 | A1 * | 5/2011 | Desai et al. | 701/208 |

OTHER PUBLICATIONS

Chen et al., A crash avoidance system based upon the cockroach escape response circuit, Apr. 1997, IEEE.*

* cited by examiner

*Primary Examiner* — Thomas G Black
*Assistant Examiner* — Sara Nelson
(74) *Attorney, Agent, or Firm* — Gifford, Krass, Sprinkle, Anderson & Citkowski, P.C.

(57) ABSTRACT

A back-propagating intersection collision avoidance system is provided. The system can include a first vehicle and a second vehicle, the first and second vehicles each operable to approach an intersection at a definable velocity and acceleration. In addition, the intersection can have a collision zone in which the first and second vehicles will collide if they are present there at the same time. The first vehicle can have a processing unit with a controller and a microprocessor, the microprocessor having an algorithm with a disturbance model. The processing unit is operable to back-propagate from the collision zone a capture set as a function of a disturbance for the first and second vehicles.

7 Claims, 6 Drawing Sheets

COMPUTATIONALLY EFFICIENT INTERSECTION COLLISION AVOIDANCE SYSTEM

CROSS-REFERENCE TO RELATED APPLICATIONS

This application is a continuation-in-part of U.S. patent application Ser. No. 12/796,978 filed Jun. 9, 2010, which is incorporated herein by reference in its entirety.

GOVERNMENT INTEREST

This invention was made with government support under CMMI0854907 awarded by the National Science Foundation. The government has certain rights in the invention.

FIELD OF THE INVENTION

The present invention is related to an intersection collision avoidance system, and in particular, an intersection collision avoidance system that has a processing unit with a disturbance model that can back-propagate a capture set from a collision zone as a function of a disturbance for a motor vehicle.

BACKGROUND OF THE INVENTION

Studies have shown that more than 30% of all accidents in the United States occur at intersections. As such, the U.S. Department of Transportation has initiated a study into intersection collision avoidance systems and several publications and systems for reducing or eliminating collisions at intersections have been proposed. For example, U.S. Pat. No. 7,295,925 discloses an accident avoidance system that includes a positioning system arranged in each vehicle that determines the absolute position of each vehicle and then uses the position information to prevent two or more vehicles from being at the same place at the same time. However, such a system involves determination of the absolute position of a first vehicle and a second vehicle, information regarding which lane the first and second vehicles are in, weather conditions, accident conditions and the like. As such, a relatively complex system is disclosed and an intersection collision avoidance system that is relatively simple and yet reliable would be desirable.

SUMMARY OF THE INVENTION

A back-propagating intersection collision avoidance system is provided. The system can include a first vehicle and a second vehicle, the first and second vehicles each operable to approach an intersection at a definable velocity and acceleration. In addition, the intersection can have a collision zone in which the first and second vehicles will collide if they are present there at the same time.

The first vehicle can have a processing unit with a controller and a microprocessor, the microprocessor having an algorithm with a disturbance model. The processing unit is operable to back-propagate from the collision zone a capture set as a function of a disturbance for the first and second vehicles. The processing unit can also determine if the first and second vehicles are within the capture set, and if not, determine if the first and second vehicles will enter the capture set. In the event that the first and second vehicles are not in the capture set, the processing unit can also instruct the controller to accelerate or de-accelerate the first vehicle in order to prevent the first vehicle from entering the capture set.

The processing unit with the disturbance model can calculate a disturbance as a function of uncertainty from actuator delays for the first vehicle, actuator delays for the second vehicle, discrete time steps used by the microprocessor and the algorithm, communication time delays, vehicle dynamics for the first vehicle, and/or vehicle dynamics for the second vehicle. In some instances, the processing unit with the disturbance model calculates a worst case scenario for the first vehicle and/or the second vehicle. Furthermore, the processing unit with the disturbance model can also calculate a disturbance even though the current dynamics of the first vehicle are not known entirely, the current dynamics of the second vehicle are not known entirely, the current state of the first and second vehicle is not known due to communication delays, the current state of the first and second vehicle is not known due to sensor noise, and/or the current state of the second vehicle is not known due to the fact that the second vehicle is a non-communicating vehicle. In the event that the second vehicle is a non-communicating vehicle, the processing unit with the disturbance model can calculate or model the second vehicle as a complete disturbance.

DETAILED DESCRIPTION OF THE INVENTION

Figure 1:
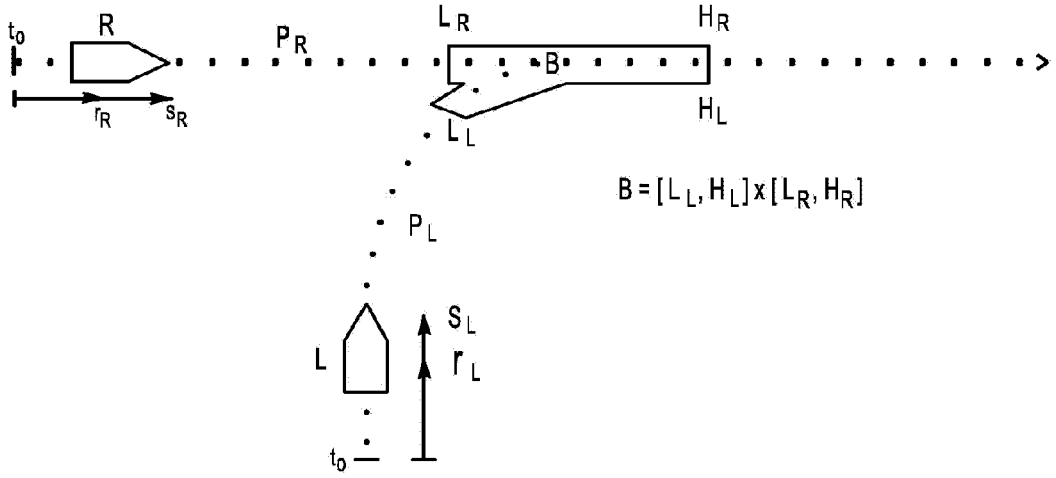
FIG. 1 is a schematic illustration of an intersection scenario where an intersection collision avoidance system according to an embodiment of the present invention can be applied.

The present invention discloses a back-propagating intersection collision avoidance (ICA) system for preventing two or more vehicles from colliding at an intersection. The ICA system can calculate predicted positions of the two or more vehicles in the near future, and both the current and future positions can be broadcast to surrounding vehicles using vehicle-to-vehicle communication. For each vehicle, a set of states, for example position, speed, acceleration, and the like, where a collision is imminent can be identified using state information for a local vehicle, a remote vehicle, and a known collision zone for the intersection. If the current states of the vehicles are determined to be in danger of entering the collision zone, the ICA system can control the vehicles to perform evasive driving maneuvers and/or alert the drivers.

The back-propagating ICA system can include an intersection with a known collision zone, a first vehicle and at least a second vehicle. The first vehicle and the second vehicle are each operable to approach an intersection at a definable velocity and acceleration and the collision zone is defined as an area of the intersection in which the first vehicle and the second vehicle will collide if present therewithin at a same time.

The back-propagating ICA system can also include a microprocessor with an algorithm, the microprocessor with the algorithm operable to back propagate from the collision zone a capture set as a function of a position, velocity, and acceleration of the first vehicle and the second vehicle. The capture set defines a plurality of locations that if occupied by the first vehicle and the second vehicle results in the two vehicles entering the collision zone at the same time. The microprocessor with the algorithm can also determine if the first vehicle and the second vehicle are within the capture set and/or if the first vehicle and the second vehicle will enter the capture set during a predetermined time step given the position, velocity, and acceleration of each of the vehicles.

A controller can also be included, the controller being in communication with the microprocessor and operable to afford acceleration and/or de-acceleration of the first vehicle and/or the second vehicle. In this manner, the controller can afford for the first vehicle and/or the second vehicle to take an evasive driving maneuver and thereby prevent the vehicles from entering the collision zone at the same time.

The capture set can be an overlap of a first vehicle capture set and a second vehicle capture set. The first vehicle capture set defines a plurality of locations as a function of the position, velocity, and acceleration of the first vehicle that guarantee the first vehicle will enter the collision zone within a first range of time. Likewise, the second vehicle capture set defines a plurality of locations as a function of the position, velocity, and acceleration of the second vehicle that guarantee the second vehicle will enter the collision zone within a second range of time. It is appreciated that the first range of time and the second range of time can at least partially overlap each other and thus the first vehicle and the second vehicle are prevented from entering the collision zone of the intersection at the same time.

In some instances, the microprocessor with the algorithm can be attached to at least one of the vehicles. In addition, the microprocessor can be a first microprocessor and a second microprocessor which may or may not be attached to the first vehicle and the second vehicle, respectively. In such an instance, each of the microprocessors is operable to back propagate from the collision zone a capture set for the respective vehicle as a function of the vehicle's position, velocity, and acceleration relative to the intersection. In addition, each of the microprocessors is capable of determining if the respective vehicle is within the respective capture set and/or if the respective vehicle will enter the capture set within a given predetermined time period. The first microprocessor can be in communication with the second processor via vehicle-to-vehicle wireless communication that affords for the position, velocity, and acceleration of each vehicle to be shared with the other vehicles.

The controller can include a first controller and a second controller that may or may not be attached to the first vehicle and the second vehicle, respectively. The first controller can be in communication with the first microprocessor and be operable to afford for acceleration and/or de-acceleration of the first vehicle, while the second controller can be in communication with the second microprocessor and be operable to afford for acceleration and/or de-acceleration of the second vehicle. In this manner, if the microprocessor, or the first microprocessor and the second microprocessor, determine the first vehicle and/or the second vehicle are not currently within the capture set, but will enter the capture set without evasive driving maneuvers, the controller, or the first controller and the second controller, can afford for acceleration and/or de-acceleration of the first vehicle and/or the second vehicle. In the alternative, if the microprocessor, or the first microprocessor and second microprocessor, determine the first vehicle and the second vehicle are currently within the capture set, the driver of each vehicle can be alerted that a collision in the intersection is imminent. Upon being alerted, it is appreciated that a driver can take additional evasive driving maneuvers in order to avoid a collision in or at the intersection.

A process for avoiding a collision between at least two vehicles approaching an intersection is also disclosed. The process includes providing an ICA system, for example as described above, the ICA system back-propagating a capture set as a function of a position, velocity, and acceleration of a first vehicle and at least a second vehicle that are approaching the intersection. The process also includes determining if the first vehicle and the second vehicle are within the capture set, and if not, determining if the first vehicle and the second vehicle will enter the capture set within a predetermined period of time. In the event that the first vehicle and the second vehicle are within the capture set, the process includes warning the driver of the first vehicle and/or the second vehicle that a collision at the intersection is imminent. In the alternative, if the process determines that the first vehicle and the second vehicle are not within the capture set, but will enter the capture set within the predetermined period of time, the ICA system can afford for acceleration and/or de-acceleration of the first vehicle and/or the second vehicle. It is appreciated that the acceleration and/or de-acceleration can provide evasive maneuvering of the vehicle(s) in order to avoid a collision at the intersection.

In order to aid in the teaching of the invention, and yet not limit its scope in any way, one or more embodiments of the ICA system and/or ICA system components are described below.

ICA Algorithm

An ICA algorithm used in combination with an ICA system affords for control of one or more vehicles to avoid a variety of vehicle collision scenarios at intersections. For example, the ICA algorithm can be used to avoid a two-car collision at a T-style intersection with such a scenario used below for teaching purposes.

Collisions are predicted based on a known collision zone and vehicle position information shared among vehicles approaching the intersection via vehicle-to-vehicle wireless communication. For the purposes of the present invention, the term "collision zone" is defined as an area of an intersection where collisions are likely to occur if and/or when two or more vehicles are present at the same time.

The ICA algorithm exploits structural properties of road systems such as: (1) on a given path, a vehicle can move in only one direction; (2) for a fixed path, a higher control force will lead to higher longitudinal position and speed along the path (also known as partial ordering); and (3) for a fixed path and control force, two vehicles, one in front of the other, will remain in that order if the two vehicles maintain the same speed and wheel torque (also known as order-preserving dynamics).

The ICA algorithm is computationally efficient in that it is linear in complexity with the number of state variables. In addition, the ICA algorithm is not conservative in that the algorithm commands control of the vehicle only when absolutely necessary. It is appreciated that the ICA algorithm can be used with a safety multi-agent research test-bed (SMART) system, the SMART system/platform allowing access of vehicle state information and sharing of the information among vehicles.

DEFINITIONS

Time used by the ICA algorithm is represented in two different forms in order to reflect that while time is continuous, it can be discretized for calculation by the microprocessor. The symbol k is used where discrete time steps are explicitly required, and the symbol t is used in more theoretical examples where a continuous variable is appropriate. As such, Equation 1 can be used for time calculations:

$$t=k\Delta T+t_0$$

$$k=0, 1, 2, 3, \quad (1)$$

where ΔT is a predefined time step, for example 100 milliseconds, and $t_0$ is an initial time where calculations, data retrieval, etc. are initiated.

Since the ICA system operates with at least two vehicles, one vehicle is considered to be local (L) while the other vehicles are considered to be remote (R).

The ICA system incorporates a longitudinal displacement along a predefined path, for example a road lane, to represent a vehicle position. It is appreciated that such a representation of vehicle position is a simplification of traditional collision detection which typically uses universal transverse Mercator (UTM) coordinates. The longitudinal displacement (r) of a vehicle i is equated to $r_i$ where i is a subset of L, R. The speed (s) and acceleration (a) are also defined along the predefined path with $s_i$ designating the longitudinal speed of vehicle i and $a_i$ designating the longitudinal acceleration of vehicle i. Again, i is a subset of L, R.

A vehicle can have a current torque value where a negative torque is for braking and a positive torque is for acceleration. Each vehicle can have a range of allowable torque represented by a maximum and minimum torque value. The symbol $\tau_i$ represents a current torque value of vehicle i, $\tau_{min_i}$ represents a minimum torque value of vehicle i, and $\tau_{max_i}$ represents a maximum torque value of vehicle i. Similarly, the vehicles have a minimum and maximum allowable speed with a minimum speed value set to be greater than zero and a maximum speed value set such that the speed of the vehicle is not uncomfortable and/or unsafe for the driver. The symbol $s_{min_i}$ represents the minimum longitudinal speed of vehicle i, and $s_{max_i}$ represents the maximum longitudinal speed of vehicle i.

Regarding a collision zone, FIG. 1 illustrates an intersection scenario where the ICA system can be applied. The collision zone, also known as the bad set B, can be represented by two longitudinal displacement intervals, one for each vehicle, where a collision will occur if both vehicles are within their interval at the same time. As such, there is a collision if and only if at least two vehicles are in the bad set B simultaneously. The bad set can be defined for each vehicle by two longitudinal displacement values, $L_i^0$ and $H_i^0$, where $L_i^0$ represents a lower bound of displacement and $H_i^0$ represents an upper bound of displacement for vehicle, i.

Figure 2:
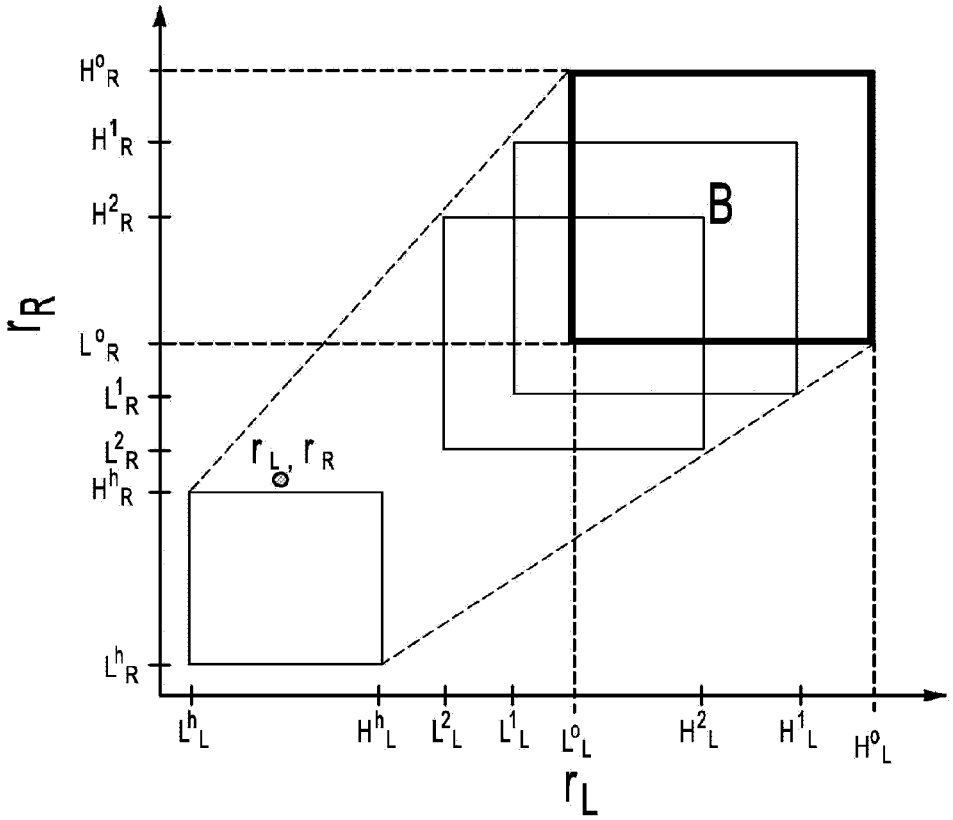
FIG. 2 is a graphical representation of a collision zone for the intersection shown in FIG. 1.

FIG. 2 provides a graphical representation of the lower bound and upper bound for each vehicle with i being a subset of L, R. As shown in FIG. 2, the bad set can be represented as a rectangle. It is appreciated that the rectangle shown in FIG. 2 is not an over approximation of the bad set and the speed of both vehicles is assumed to be constant with the axis for the local vehicle and the remote vehicle representing displacement.

The series of rectangles propagating back towards the origin of the graph represents back-propagation steps from the bad set as a function of time. The capture set is the union of the back-propagation rectangles and the bad set. As stated earlier, the capture set represents all system configurations from which at least two vehicles are guaranteed to enter the bad set B regardless of control action taken.

For example, consider a vehicle traveling at a speed v along a straight line toward a wall. Assuming x to be a distance of the vehicle along the straight line from the wall, and assuming that the vehicle can brake, given any pair of distance and speed (x, v) and a maximum feasible braking, if x is too small and v is too high, then even with maximum allowed braking the vehicle will be unable to avoid a crash with the wall. As such, the set of all such pairs of distance and speed for which no control input exists that will avoid a crash with the wall is a capture set C for such a simple example and the role of the ICA system is to keep the vehicle out of the capture set and thereby avoid a crash of the vehicle with the wall by braking the vehicle before it is too late.

Referring back to the intersection of FIG. 1, the bad set can be represented as shown in Equation 2, and the capture state can be stated to be all states that lead to B.

$$B=[L_L,H_L]\times[L_R,H_R] \quad (2)$$

In addition, a collision occurs if there is a time for which both vehicles are within the bounds of their respective bad sets, represented mathematically as shown in Equation 3.

$$\exists t: r_L(t)\in[L_L,H_L] \text{ and } r_R(t)\in[L_R,H_R] \quad (3)$$

It is appreciated that Equation 3 can be summarized by Equation 4 with the combined vehicle states r(t) being within the overall bad set B.

$$\exists t: r(t)\in B \quad (4)$$

Algorithm

The ICA algorithm can perform four general steps: (1) state estimation; (2) back propagation; (3) collision detection; and (4) control. Avoiding or preventing a collision can be summarized as avoiding the capture set C. If a vehicle avoids the capture set, it will not enter the bad set B and thus avoid a collision.

The algorithm can be applied to systems defined by:

$$\Sigma=(\chi;U;O;f;h) \quad (5)$$

where χ equals the states, (U, ≤) equals the inputs, (O, ≤) equals the outputs, f(x, u) equals a piecewise continuous vector field, and h equals an output map. In addition, Equations 6-14 must hold and f(x, u) must be at least piecewise continuous.

$$\dot{x} = f(x, u) \tag{6}$$

$$\dot{x}_1 = f_1(x, u) \tag{7}$$

$$\dot{\bar{x}} = \bar{f}(x, u) \tag{8}$$

$$x = \begin{bmatrix} x_1 \\ x \end{bmatrix} \tag{9}$$

$$x \in R^n,\ u \in U \tag{10}$$

$$0 < f_1(x, u) \tag{11}$$

$$f_1 : R^n \times U \Rightarrow R^+ \tag{12}$$

$$(U,\ \leq) \tag{13}$$

$$u_1(t) \leq u_2(t) \Rightarrow u_1 \leq u_2 \tag{14}$$

In addition, Equations 15 and 16 must be true.

$$u_1 \leq u_2 \Rightarrow f(x,u_1) \leq f(x,u_2) \tag{15}$$

$$\bar{x}_1 \leq \bar{x}_2 \Rightarrow f(\bar{x}_1,u) \leq f(\bar{x}_2,u) \tag{16}$$

Figure 3:
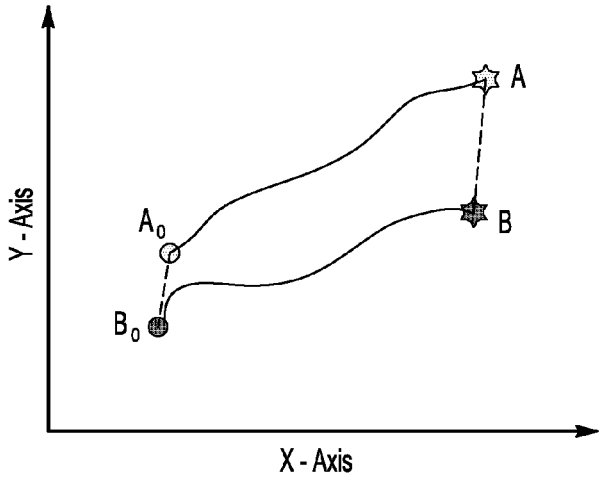
FIG. 3 is a schematic illustration of a partially ordered system assumed in an embodiment of the present invention.
Figure 4:
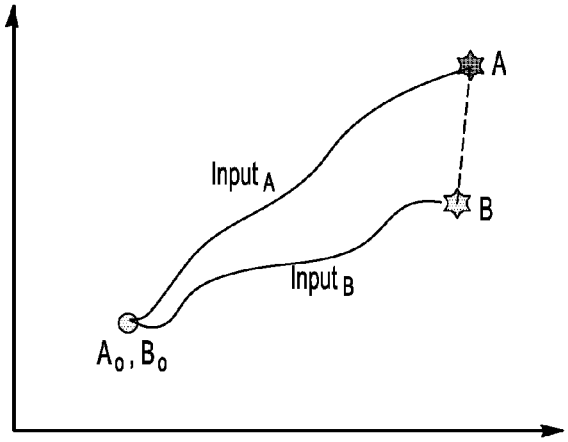
FIG. 4 is a graphical representation of an order-preserving system assumed in an embodiment of the present invention.

Represented graphically, FIG. 3 illustrates a system that is partially ordered in that if two states start in one order, and the same input is applied to each state, the two states will remain in that order. In addition, FIG. 4 illustrates a system that is order preserving in that if two states begin as equal and different inputs are applied to each state, the two states will end up ordered the same as their inputs.

The ICA system uses a vehicle model to determine one or more states that will lead the vehicle to be within the capture set, as well as to estimate the vehicle state in a subsequent step. A generic vehicle model can be a function of two parameters: one parameter specialized or oriented towards speed (z) and one oriented towards acceleration (w). The generic model considers three arguments: (1) ΔT; (2) maximum speed of the vehicle; and (3) minimum speed of the vehicle. It is appreciated that the generic model requires the vehicle speed to increase according to the acceleration, unless the vehicle is outside a valid speed range. Expressed mathematically, Equation 17 provides a relationship for the generic model with an additional term added to the function F to add uncertainty to the algorithm.

$$F(z, w; D, m, M) := \begin{cases} z + Wd & \text{if any of} \begin{cases} M > z > m \\ z \leq m \text{ and } w > 0 \\ z \geq M \text{ and } w < 0 \end{cases} \\ z & \text{otherwise} \end{cases} \tag{17}$$

A specialized vehicle model as shown in the expressions below consists of two parameters: a torque to acceleration factor ($m_{fac_i}$) and a torque to acceleration offset ($m_{off_i}$) are used. It is appreciated that a more complicated vehicle model can be used with only a linear increase in computational complexity with the number of variables. The longitudinal displacement ($r_i$), speed ($s_i$), and acceleration ($a_i$) are defined for the local vehicle and a remote vehicle. The local vehicle and the remote vehicle can use the same model with the possibility of different vehicle model parameters.

$$r_i(k+1) = r_i(k) + s_i(k)\Delta T \tag{18}$$

$$s_i(k+1) = F(s_i(k), a(k); \Delta T, s_{min_i}, s_{max_i}) \tag{19}$$

$$a_i(k) = m_{fac_i \tau_i}(k) + m_{off_i} \tag{20}$$

where: $\tau min_i \leq \tau \leq \tau_{max_i} \Rightarrow a_{min_i} \leq a \leq a_{max_i}$ and $i \in L, R$ It is appreciated that there are two distinct classes of conflict detection and resolution methods—forward methods and backward methods. Forward methods predict a conflict in the future by propagating forward the current system state and checking where the system leads to conflict. In contrast, backward methods compute online a set of all system configurations that will lead to a conflict. As such, backward-propagation methods require a predetermined set of states that are collisions, for example the bad set. It is appreciated that an advantage of backward propagation methods is that such methods can provide control algorithms for conflict resolution that are mathematically guaranteed to be "safe".

A recursive method $S_i^h$ is defined for calculating a current speed based on a speed at a previous time step and a current acceleration (see Equations 21 and 22) and is used in back-propagation to determine a distance the vehicle travels in one time step.

$$S_i^h(s_i, a_i) = s_i \tag{21}$$

$$S_i^h(s_i, a_i) = F(S_i^{h-1}(s_i, a_i), a_i; \Delta T, s_{min_i}, s_{max_i}), \forall h \in 1, 2, \tag{22}$$

The recursive method uses the following expressions with two methods defined for calculating a lower and upper bound of possible vehicle state sets at a previous time step. The first method is represented by Equations 23-26 and the second method represented by Equations 27-32. In particular, for each value of h a new frame in the set is calculated, $$L_i^0 = L_i \tag{23}$$

$$L_i^h(s_i, a_i) = L_i - \sum_{j=0}^{h-1} S_i^j(s_i, a_i)\Delta T,\ \forall\ h \in 1, 2, \ldots \tag{24}$$

$$H_i^0 = H_i \tag{25}$$

$$H_i^h(s_i, a_i) = H_i - \sum_{j=0}^{h-1} S_i^j(s_i, a_i)\Delta T,\ \forall\ h \in 1, 2, \ldots \tag{26}$$

$$L_i^0 = L_i \tag{27}$$

$$L_i^h(s_i, a_i) = L_i^{h-1}(s_i, a_i) - S_i^{h-1}(s_i, a_i)\Delta T \tag{28}$$

$$(L_i^h, S_i^{h-1}) = f(L_i^{h-1}, S_i^{h-2}) \tag{29}$$

$$S_i^{h-1} = F(S_i^{h-2}, a_i) \tag{30}$$

$$L_i^h = L_i^{h-1} - S_i^{h-1}\Delta T \tag{31}$$

$$L_i^h(S_i(k)) = L_i^{h-1}(S_i(k+1)) - S_i(k)\Delta T \tag{32}$$

It is appreciated that for each step of calculating a bound, a previous bound as well as a previous bound recalculated with a current speed are required.

Next, a method $C_a$ can be defined to calculate a capture set for a pair of vehicle states. Starting at the bad set (that is $L_i = L_0^i$ and $H_i = H_0^i$), the method $C_a$ creates sets that ultimately form the capture set. Mathematically, the method $C_a$ can be expressed by Equation 33 below.

$$C_a(r_L, s_L, a_L, r_R, s_R, a_R) := \left\{ \begin{array}{l} (x_L, x_R) \in \chi : \exists\, h \geq 0 : \; L_L^h(s_L, a_L) < x_L < H_L^h(s_L, a_L) \text{ and} \\ \qquad L_R^h(s_R, a_R) < x_R < H_R^h(s_R, a_R) \text{ and} \\ \qquad H_L^h(s_L, a_L) \leq x_L \text{ and} \\ \qquad H_R^h(s_R, a_R) \leq x_R \end{array} \right\} \tag{33}$$

The method $C_a$ can be applied twice in order to create a capture set for the local vehicle ($C_L$) and a capture set for the remote vehicle ($C_R$). The two sets $C_R$ and $C_L$ cover two possible control scenarios with $C_L$ being the capture set if the local vehicle applies a maximum torque and the remote vehicle applies a minimum torque. The set $C_R$ is the opposite case, i.e. the local vehicle applies a minimum torque and the remote vehicle applies a maximum torque. Equations 34 and 35 provide expressions for the two capture sets as a function of the position, speed, and acceleration of the local vehicle and the remote vehicle:

$$C_L = C_a(r_L(k), s_L(k), a_{max_L}, r_R(k), s_R(k), a_{min_R}) \tag{34}$$

$$C_R = C_a(r_L(k), s_L(k), a_{min_L}, r_R(k), s_R(k), a_{max_R}) \tag{35}$$

with the intersection of the two sets $C_L$ and $C_R$ defining the final capture set C.

$$C = C_L \cap C_R \tag{36}$$

Figure 5:
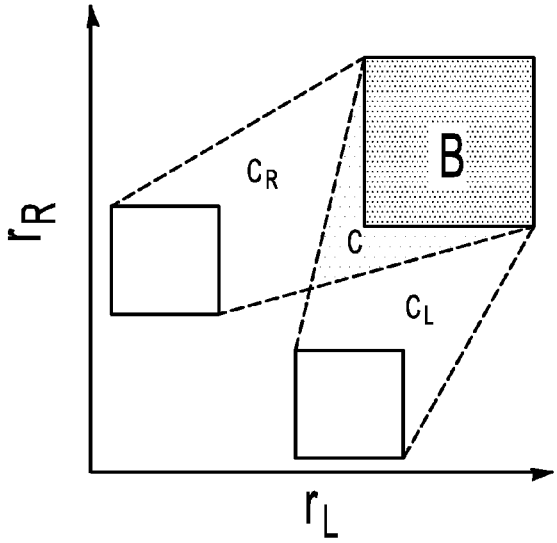
FIG. 5 is a graphical representation of a capture set for two vehicles approaching an intersection.

FIG. 5 illustrates a graphical representation of the final capture set C as an intersection of the two sets $C_L$ and $C_R$ and the final capture set C includes all states where the local vehicle and the remote vehicle are guaranteed to enter the bad set B.

Regarding collision detection, the ICA algorithm checks and/or determines if current vehicle states are in the final capture set C. Starting at the known bad set B and working backward, the ICA algorithm iterates over all predefined times for the final capture set C and checks to determine if a vehicle state at that time is within the boundaries of the set. Mathematically, the algorithm incorporates Equation 37 shown below.

$$r(k) = (r_L(k), r_R(k)) \in C$$

with $$r_L \leq H_L^h \text{ and } r_R \leq H_R^h$$

$$r_L > L_L^h \text{ and } r_R > L_R^h \tag{37}$$

It is appreciated that since a current vehicle state membership in the final capture set C is an exit condition for the back-propagation steps/calculations, the check or analysis for if a vehicle state is within the boundaries of the capture set can already be completed by the back-propagation procedure. Stated differently, the back propagation stops or exits either if the current vehicle state is in the last generated frame or if the last generated frame is past the current vehicle state.

If the state of the vehicle is inside the frame for both $C_L$ and $C_R$, it is known that the vehicle states are within the final capture set C. In addition, this check/analysis can be performed twice, once for the capture set of the current vehicle state and once for the capture set of the next predicted vehicle state. The results of both checks can be used to determine a necessary control action, and combined with a current state, provide information as to whether or not a vehicle is approaching a collision scenario or is resolving a collision scenario.

A vehicle is considered to be at a boundary of the final capture set when the current state of the vehicle is outside the capture set and the next state of the vehicle is inside the capture set. In such an instance, if no control is actuated, the vehicle will enter the capture set in the next iteration. As such, the ICA system allows for a non-conservative control response in that the vehicle is controlled only when absolutely necessary. Stated differently, if the current state of the vehicle is not in the capture set and the next state predicts the vehicle will not be in the captures set, then the ICA system does not actuate control of the vehicle.

In the alternative, the vehicle can be considered to be at the boundary of the final captures set when the next 'N' states of the vehicle are predicted to be outside the capture set. In such an alternative, it is appreciated that if the vehicle is predicted to be inside the capture set within the next N states, then control is actuated. It is further appreciated that N can be an integer, for example and for illustrative purposes only, an integer equal to or less than 3, equal to or less than 5, or equal to or less than 10. It is still further appreciated that the prediction of the next N states of the vehicle can afford for a robust ICA system with respect to wireless communication delays.

A controller affords for one or more of the vehicles to accelerate or brake in order to avoid a collision. The controller also preserves liveliness of the system by observing minimum speeds for each vehicle. In the event that a current vehicle state and a next vehicle state lie outside of the capture set, then any control input is allowed. In the alternative, if a current vehicle state lies outside of the capture set but the next vehicle state is within the capture set, the relationship between the current position and the capture set can be used to determine which vehicle should accelerate and which vehicle should brake.

Figure 6:
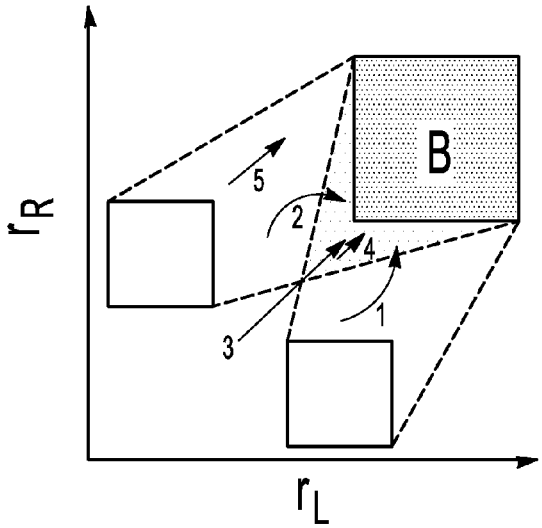
FIG. 6 is a graphical representation of five different scenarios of two vehicles approaching an intersection.

Five cases handled by the control algorithm are illustrated in Table 1 and FIG. 6. The torques defined for control output are wheel torque and as such may be accomplished either by brake torque or engine torque. In addition, any control can be acceptable as long as the control is measurable, controllable, and order preserving with the torque. Case 1 illustrates a scenario where braking is applied to the local vehicle and acceleration applied to the remote vehicle. Case 2 illustrates where acceleration is applied to the local vehicle and braking is applied to the remote vehicle.

Regarding Case 3, the algorithm affords for the vehicle with a lower identification (ID) to brake while the vehicle with a higher identification ID to accelerate. It is appreciated that the ICA system can afford for confirmation via wireless communication that each vehicle will take opposite control actions, e.g. one vehicle will brake while another vehicle will accelerate, before control is actuated. In this manner, the ICA system can be robust to sensor uncertainties.

For Case 4 both the local vehicle and the remote vehicle are within the capture set and thus no control can be made to prevent the vehicles from entering the bad set B. As such, no control of the vehicle is asserted by the ICA system but a strong warning is provided to the drivers. Finally, for Case 5, neither vehicle is within the bad set and as such control is not necessary.

TABLE 1

The ICA control algorithm.

| Next State | | Current State | | Control | | |
|---|---|---|---|---|---|---|
| $r(k+1) \in C_L$ | $r(k+1) \in C_R$ | $r(k) \in C_L$ | $r(k) \in C_R$ | $\tau_L$ | $\tau_R$ | Case |
| 4 * T | 4 * T | True | False | $\tau_{minL}$ | $\tau_{maxR}$ | 1 |
| | | False | True | $\tau_{maxL}$ | $\tau_{minR}$ | 2 |
| | | False | False | if $ID_L \leq ID_R$, $\tau_{minL}$ | if $ID_L < ID_R$, $\tau_{maxR}$ | 3 |
| | | True | True | no control; strong warning | | 4 |
| else | | | | do nothing | | 5 |

It is appreciated that a more traditional dynamic model can be used to determine acceleration of a vehicle rather than the vehicle model parameters $m_{fac}$ and $m_{off}$. Such a traditional model is provided by Equation 38 where the wheel torque is simply the product of the engine torque and the ratio of the current gear for acceleration or the pressure of the brakes times their effectiveness for de-acceleration:

$$a=1/m\times(\tau_w(v)/r_w-\tfrac{1}{2}\rho C_d A v^2) \tag{38}$$

where $\tau_w$ is wheel torque, m is vehicle mass, $\rho$ is the density of air, $C_d$ is the drag coefficient, A is the projected front area of the vehicle, $r_w$ is the radius of the vehicle wheels and $v$ is the vehicle speed. As such, a map of engine torque to wheel torque can be provided if the current gear and brake pressure are known. The gear is determined by the speed, however there can be overlap between gears and as such no one-to-one mapping between velocity and gear can be provided. In such a case, $g(v)$ can be used to represent the gear at a certain velocity, b can be used to represent brake pressure, and p can be used to represent throttle pedal percentage. With such definitions, Equations 39 and 40 provide expressions for torque at the wheels of the vehicle. In this manner, the ICA system can map "maximum torque" and "minimum torque" to a throttle pedal percentage and a brake pedal percentage.

$$\tau_{wheel}(v)=\tau_{wheel}(\tau_{engine}g,\tau_{brake}) \tag{39}$$

$$\tau_{wheel}(v)=\tau_{wheel}(\tau_{engine}(p),g(v),\tau_{brake}(b)) \tag{40}$$

As stated above, two vehicles approaching an intersection will result in a collision if both vehicles occupying the collision zone of the vehicle at the same time. In order to prevent such an event from happening, the ICA system gathers data for the current state of the local vehicle, converts it to longitudinal displacement and speed, and then calculates the next predicted position using the vehicle model. Thereafter, the system calculates the capture set for the next predicted position which is the intersection of the capture sets of the two vehicles. If the next position is within the capture set, the system generates a capture set for the current position. If the current position is not in the capture set, the system recognizes that one or more of the vehicles is or will enter the set if no control is provided.

The ICA system also determines if the local vehicle is entering the capture set from "below" and if so applies a maximum torque or if the local vehicle is entering the capture set from "above" applies a minimum torque. In an alternative, arbitrary control actuation can be performed by determining which vehicle should exhibit minimum torque and which vehicle should exhibit maximum torque in order to avoid a collision. If the current position is within the capture set, no control is provided but the driver is warned of an imminent collision.

Preferably, both vehicles have access to the same data from every iteration performed by the system and identical computation is performed by each microprocessor of the vehicles. However, due to communication delays, the computations can actually be up to three iterations apart and in order for the vehicles to agree on their control methods, commands are broadcast and agreed upon before execution.

Figure 7:
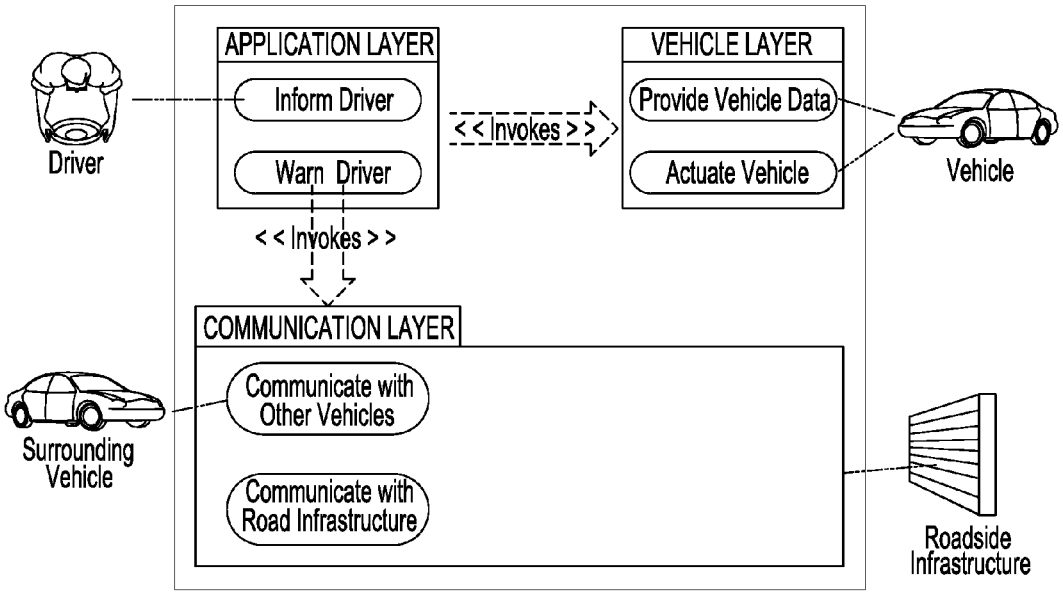
FIG. 7 is a schematic representation of the boundaries for an intersection collision avoidance (ICA) system according to an embodiment of the present invention.

Turning now to FIG. 7, a schematic representation of boundaries for a SMART system is shown. It is appreciated that the parameters, capabilities and the like of the SMART system are known to those skilled in the art and thus not discussed in detail here. Within the outer rectangle are different high-level functionalities or use cases indicated within the horizontal ovals. External to the rectangle are external actors that interact with the SMART system via the use cases. For the purposes of the present invention, the term "use case" is defined as a sequence of actions that provide something of measurable value to an actor, is drawn as a horizontal ellipse and/or oval, and is specified using "upper camel case" and "lower camel case" following Java-like naming convention. The term "actors" is defined as a person, organization, and/or external system that plays a role in one or more interactions within the SMART system and can be drawn as stick figures, but are schematically shown as objects in FIGS. 7-10.

The external actors of a driver, a vehicle, surrounding vehicles, and a roadside infrastructure interact with the use cases informing the driver (InformDriver) and warning the driver (WarnDriver), and the like as shown in the figure. The SMART system architecture distributes the responsibility of implementing the functionalities or use cases among an Application Layer, a Vehicle Layer, and a Communication Layer which are indicated by the internal rectangles shown in FIG. 7. It is appreciated that the ICA algorithm belongs to the application layer.

Figure 8:
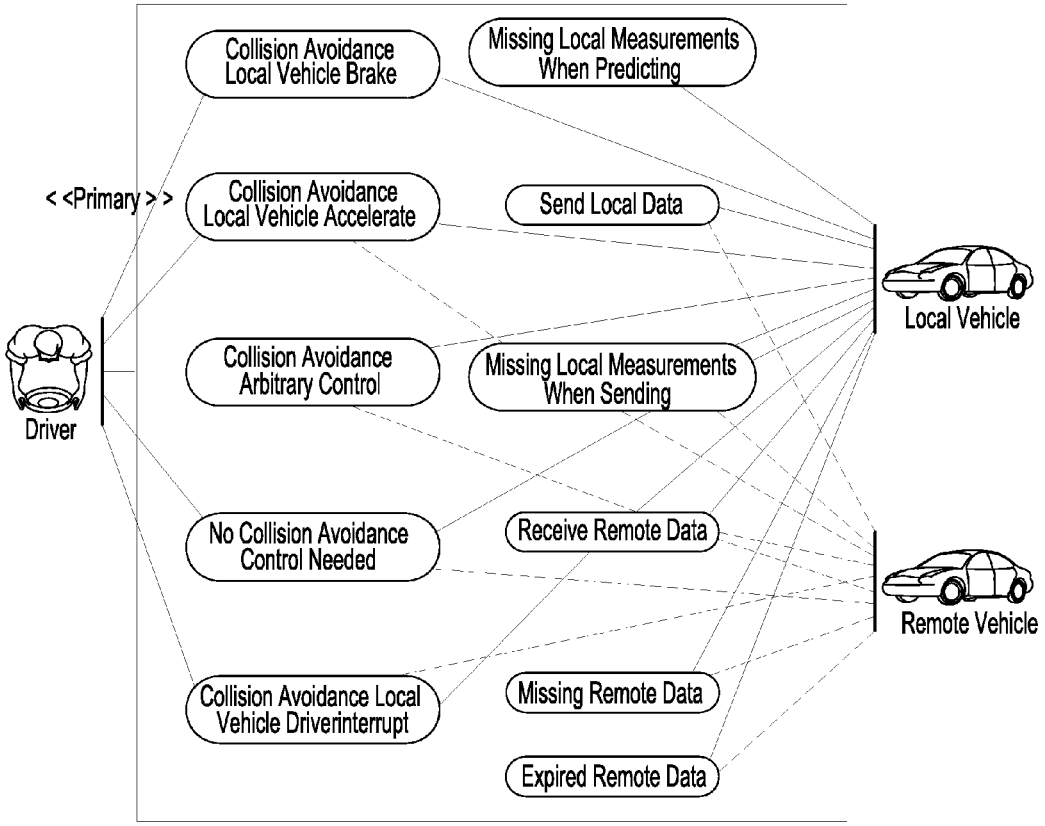
FIG. 8 is a schematic representation of system boundaries for an ICA application according to an embodiment of the present invention.

FIG. 8 illustrates possible system boundaries for the ICA system. As shown by the external actors, the system interacts with two types of vehicles, a local vehicle and a remote vehicle. In some instances, the local vehicle can update its state information with vehicle measurements using the vehicle layer while the local vehicle can be updated with the remote vehicle state information when it is received via vehicle-to-vehicle communication through the communication layer. The driver can detect and respond to collision scenarios by braking, accelerating, and/or by performing no action. As stated above for FIG. 7, the driver, local vehicle, and remote vehicle lie outside the boundaries of the ICA system.

The ICA system can have a plurality of assumptions and limitations as shown in Table 2 below. It is appreciated that the assumptions and limitations are included as nonfunctional requirements since some may or may not be relaxed or extended when desired.

TABLE 2

| Identifier | Type | Description |
|---|---|---|
| AS1 | Fundamental | ICA supports no more than 2 vehicles simultaneously. |
| AS2 | Simplification | ICA must be running on both vehicles for any functionality. This can be relaxed with the integration of roadside sensors to detect vehicles not running the application. |
| AS3 | Simplification | ICA supports T-style intersections of single-lane, one-way streets only, for simplification. |
| AS4 | Simplification | ICA application supports intersections with one conflict zone and the zone must be known and available to both vehicles. |
| AS5 | Simplification | ICA assumes drivers will not interfere with automatic evasive maneuvers, although the drivers have that capability. |
| AS6 | Fundamental | The lane path of the road must be known and available to ICA. |
| AS7 | Fundamental | ICA requires access to vehicle state information (e.g. position, speed, acceleration, etc). |
| AS8 | Fundamental | ICA must be able to actuate the engine and braking control systems in the vehicle for automatic collision avoidance. |
| AS9 | Fundamental | The vehicle model parameters (mass, engine torque, wheel size, etc) are known and available to ICA. |
| AS10 | Fundamental | ICA allows for some measurement error in the vehicle state. |

20

For example, for the present embodiment, assumption AS1 is that the ICA system supports no more than two vehicles simultaneously. This assumption can be relaxed such that more than two vehicles can be supported by the ICA system disclosed herein. Referring now to Table 3, a series of functional requirements that specify what the ICA system "does" is shown. In contrast, Table 4 provides a listing of non-functional requirements that specify constraints placed on the ICA system.

TABLE 3

| Identifier | FR1 |
|---|---|
| Description | ICA must check for collisions between a local and remote vehicle and control both vehicles to avoid imminent collisions. |
| Rationale | The application should not use conservative control, and the control must be synchronized between the vehicles. Note that if both vehicles are using the same algorithm on the same inputs, the control will inherently be synchronized. |
| Identifier | FR2 |
| Description | ICA must use only throttle and brake control to avoid collisions. |
| Rationale | The ICA algorithm does not currently support control beyond deceleration and acceleration, and the current vehicle fleet does not universally support steering control. |
| Identifier | FR3 |
| Description | The driver must be able to interrupt any automatic collision avoidance commands by using the throttle or brake. After an interruption, the driver should not have to fight the application for control. |
| Rationale | This is to allow for exceptions in extreme collision scenarios. |
| Identifier | FR5 |
| Description | ICA must receive state information broadcast by surrounding vehicles and store it. |
| Rationale | Similar to NFR1, the vehicle must always be listening for new surrounding vehicles. |
| Identifier | FR6 |
| Description | ICA must broadcast the current vehicle state via V-V communication. |
| Rationale | The vehicle may encounter a new vehicle at any time, and the state information should be provided as soon as possible. |

TABLE 4

| Identifier | NFR1 |
|---|---|
| Description | ICA must broadcast the current vehicle state 10 times per second. |
| Rationale | The vehicle may encounter a new vehicle at any time, and the state information should be provided as soon as possible. In general, ICA should send the vehicle state more often than it is updated. |
| Identifier | NFR3 |
| Description | ICA must update the local vehicle state 3-5 times per second. |
| Rationale | Similar to NFR1, the state must be updated often enough to adapt to a rapidly changing vehicle state, a common occurrence at highway speeds. |
| Identifier | NFR4 |
| Description | ICA must not use more than 50% of the CPU while running on a Core 2 Duo processor. |
| Rationale | The application must share the computing resources with other applications. |
| Identifier | NFR5 |

TABLE 4-continued

| Identifier | NFR1 |
|---|---|
| Description | ICA must exert torque in amounts not greater than a prescribed maximum. |
| Rationale | The collision avoidance control must be within the physical capabilities of the vehicle, as well as within a comfort zone for the driver. More severe torque can be applied by the driver. |

Figure 9:
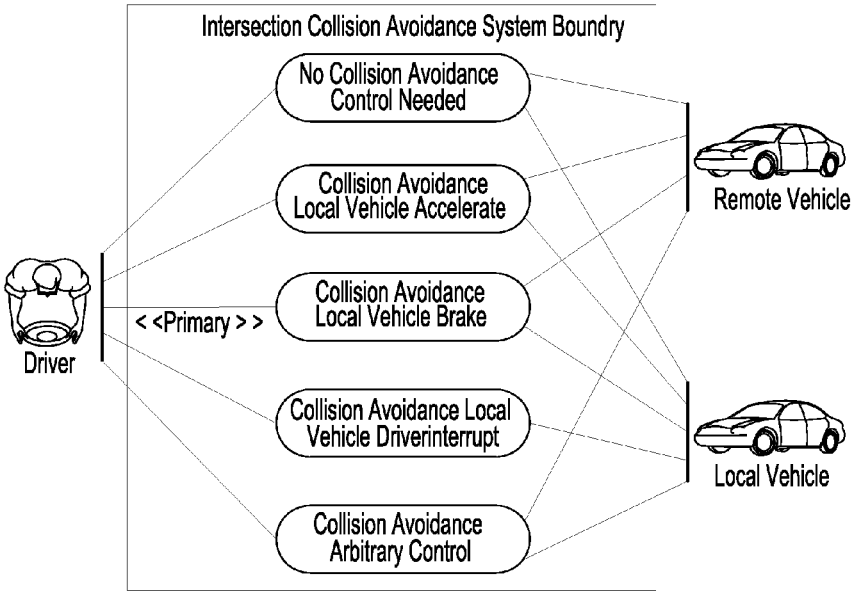
FIG. 9 is a schematic representation of "use cases" employed by an ICA system according to an embodiment of the present invention.

As stated above, a use case is a precise statement of a piece of system functionality, and a collection of key use cases can be used to specify requirements on system functionalities. As such, FIG. 9 provides a schematic representation of the use cases employed by a vehicle to detect and respond to an upcoming collision and/or to continue uninterrupted if a collision is not predicted.

It is appreciated that the remote vehicle and local vehicle actors can be connected with the collision avoidance use cases through the vehicle layer and the communication layer as illustrated in FIG. 7. Table 6 provides a list of specifications for the use cases illustrated in FIG. 9. As shown in this table, use cases of no collision avoidance control needed (NoCollisionAvoidanceControlNeeded), collision avoidance of the local vehicle by acceleration (CollisionAvoidanceLocalVehicleAccelerate), collision avoidance of local vehicle by braking (CollisionAvoidanceLocalVehicleBrake), collision avoidance by arbitrary control (CollisionAvoidanceArbitraryControl), and collision avoidance of local vehicle by driver interruption (CollisionAvoidanceLocalVehicleDriverInterrupt) are possible use cases that can be employed by the ICA system.

TABLE 6

| Use Case: NoCollisionAvoidanceControlNeeded | |
|---|---|
| ID | UC1 |
| Brief description | Two vehicles approach a T-intersection with perpendicular paths and proceed through sequentially. This will show that the system does not control if there is no collision detected. |
| Primary actors | LocalVehicle, RemoteVehicle |
| Pre-conditions | 1. Vehicles are within V-V communication range of one another.<br>2. Vehicles are both running ICA. |
| Main flow | 1. LocalVehicle begins moving forward towards intersection.<br>2. RemoteVehicle begins moving forward towards intersection from perpendicular direction, slowing to a stop to allow the LocalVehicle to pass.<br>3. ICA application gathers vehicle state information and broadcasts its current and next predicted position wirelessly.<br>4. Each vehicle compares the paths with the known conflict set and finds no collisions.<br>5. Remote Vehicle continues through intersection after LocalVehicle has passed. |
| Use Case: CollisionAvoidanceLocalVehicleAccelerate | |
| ID | UC2 |
| Brief description | Two vehicles approach a T-intersection with perpendicular paths and begin to proceed through simultaneously. The application controls both cars to avoid the collision. In this case, the local vehicle increases the throttle. |
| Primary Actors | Driver, LocalVehicle, RemoteVehicle |
| Main flow | 1. LocalVehicle begins moving forward towards intersection.<br>2. RemoteVehicle begins moving forward towards intersection from perpendicular direction, such that a collision would occur.<br>3. ICA application gathers vehicle state information and broadcasts its current and next predicted position wirelessly.<br>4. Each vehicle compares the paths with the known conflict set and finds an imminent collision.<br>5. Both cars are controlled (via throttle or brake) to avoid the collision and the drivers are notified. The local vehicle increases the throttle. |
| Use Case: CollisionAvoidanceLocalVehicleBrake | |
| ID | UC3 |
| Brief description | Two vehicles approach a T-intersection with perpendicular paths and begin to proceed through simultaneously. The application controls both cars to avoid the collision. In this case, the local vehicle applies the brakes. |
| Primary Actors | Driver, LocalVehicle, RemoteVehicle |
| Pre-conditions | 1. Vehicles are within V-V communication range of one another.<br>2. Vehicles are both running ICA. |
| Main flow | 1. LocalVehicle begins moving forward towards intersection.<br>2. RemoteVehicle begins moving forward towards intersection from perpendicular direction, such that a collision would occur.<br>3. ICA application gathers vehicle state information and broadcasts its current and next predicted position wirelessly.<br>4. Each vehicle compares the paths with the known conflict set and finds an imminent collision. |

TABLE 6-continued

| | |
|---|---|
| | 5. Both cars are controlled (via throttle or brake) to avoid the collision and the drivers are notified. The local vehicle applies the brakes. |
| | Use Case: CollisionAvoidanceArbitraryControl |
| ID | UC4 |
| Brief description | Two vehicles approach a T-intersection with perpendicular paths and begin to proceed through simultaneously. The application controls both cars to avoid the collision. In this case, the positions of the vehicle do not dictate specific control actions, so the application makes an arbitrary control choice that results in both cars performing opposite actions (i.e. which car accelerates, which car brakes). |
| Primary Actors | Driver, Local Vehicle, RemoteVehicle |
| Pre-conditions | 1. Vehicles are within V-V communication range of one another.<br>2. Vehicles are both running ICA. |
| Main flow | 1. LocalVehicle begins moving forward towards intersection.<br>2. RemoteVehicle begins moving forward towards intersection from perpendicular direction, such that a collision would occur.<br>3. ICA application gathers vehicle state information and broadcasts its current and next predicted position wirelessly.<br>4. Each vehicle compares the paths with the known conflict set and finds an imminent collision.<br>5. The positions of the cars do not dictate a specific control action - any control will do, as long as the vehicles perform opposite actions. The local vehicle decides to increase the throttle arbitrarily, and the remote vehicle decides to brake using the same logic. |
| | Use Case: CollisionAvoidanceLocalVehicleDriverInterrupt |
| ID | UC5 |
| Brief description | Two vehicles approach a T-intersection with perpendicular paths and begin to proceed through simultaneously. The application controls both cars to avoid the collision. In this case, the local vehicle increases the throttle. A driver interrupts the throttle command with a severe braking maneuver to bring the vehicle to a stop. |
| Primary Actors | Driver, LocalVehicle, RemoteVehicle |
| Pre-conditions | 1. Vehicles are within V-V communication range of one another.<br>2. Vehicles are both running ICA. |
| Main flow | 1. LocalVehicle begins moving forward towards intersection.<br>2. RemoteVehicle begins moving forward towards intersection from perpendicular direction, such that a collision would occur.<br>3. ICA application gathers vehicle state information and broadcasts its current and next predicted position wirelessly.<br>4. Each vehicle compares the paths with the known conflict set and finds an imminent collision.<br>5. Both cars are controlled (via throttle or brake) to avoid the collision and the drivers are notified. The local vehicle increases the throttle.<br>6. The LocalVehicle driver reacts differently and applies the brakes to bring the vehicle to a stop. The throttle control is overridden, and the driver notification continues until the collision is no longer predicted. |

Figure 10:
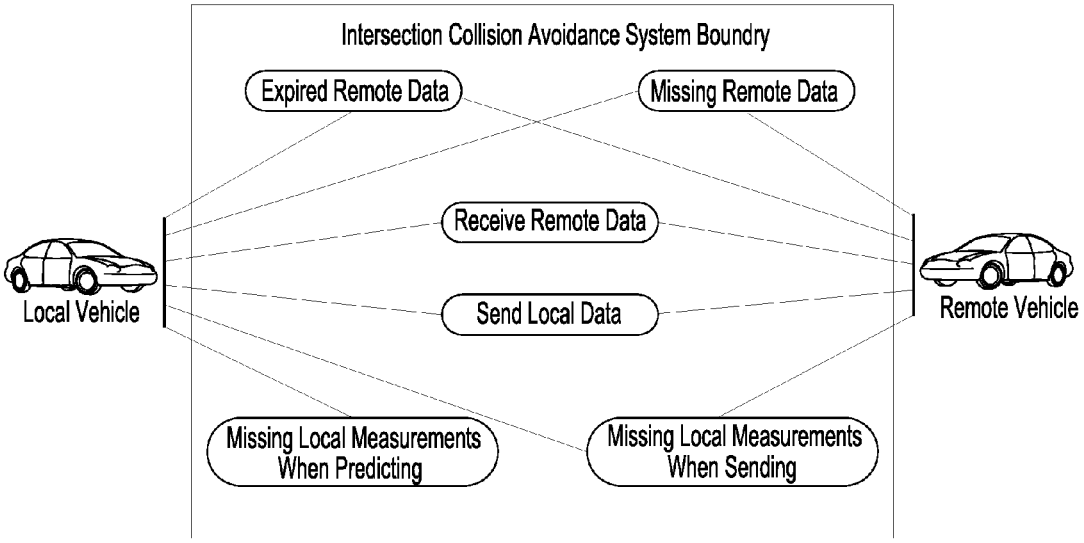
FIG. 10 is a schematic representation of use cases to sharing vehicle state data via vehicle-to-vehicle communication according to an embodiment of the present invention.
Figure 11:
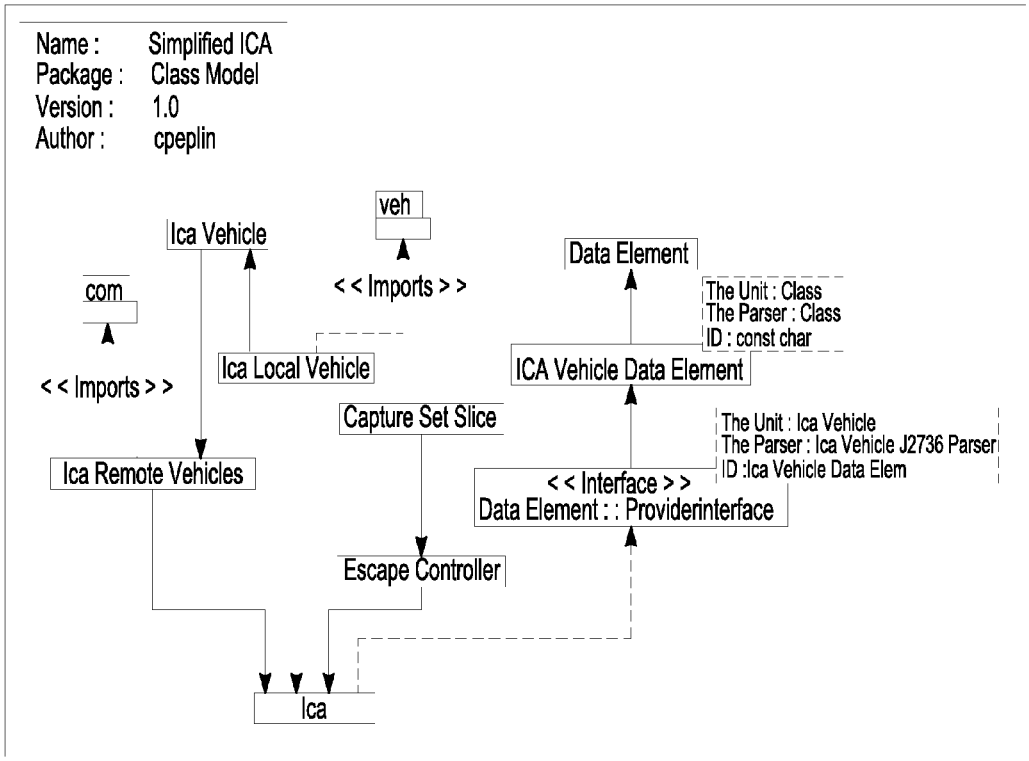
FIG. 11 is a schematic representation of a simplified class model for an ICA system according to an embodiment of the present invention.

Referring to FIG. 10, boundaries for vehicle-to-vehicle communication are shown with use cases of receive remote data, send local data, missing local measurement data when predicting, missing local measurement data when sending, missing remote data, and expired remote data being employed by the local vehicle and the remote vehicle actors to access the vehicle state, broadcast the vehicle state via the vehicle-to-vehicle communication and to gather information from surrounding vehicles. Both the local vehicle and the remote vehicle can be robust to missing or incomplete data from vehicle measurements or remote vehicles. Table 7 provides a list of the use cases shown in FIG. 10.

TABLE 7

| Use Case: ReceiveRemoteData | |
|---|---|
| ID | UC6 |
| Brief description | A vehicle receives vehicle state information broadcast from another vehicle via V-V communication. The state information is stored for future collision detection. |
| Primary actors | RemoteVehicle |
| Pre-conditions | 1. Vehicles are within V-V communication range of one another.<br>2. Vehicles are both running ICA. |
| Main flow | 1. RemoteVehicle begins listening for vehicle state information broadcast wirelessly.<br>2. RemoteVehicle receives a message from a remote vehicle and parses the state information. |

TABLE 7-continued

| | |
|---|---|
| | 3. RemoteVehicle stores the remote vehicle state, associating the data with a unique vehicle ID. |
| | Use Case: SendLocalData |
| ID | UC7 |
| Brief description | A vehicle gathers vehicle state measurements through physical sensors and broadcasts the data to the surrounding vehicles. |
| Primary actors | LocalVehicle |
| Pre-conditions | 1. Vehicles are within V-V communication range of one another.<br>2. Vehicles are both running ICA application. |
| Main flow | 1. LocalVehicle creates vehicle measurements and updates their values from the physics sensors.<br>2. LocalVehicle converts the UTM, heading and speed measurements to longitudinal displacement and speed along a path. It also predicts a "next step" location along the path.<br>3. LocalVehicle packages the measurements into a data element for the application.<br>4. LocalVehicle broadcasts the data element via V-V communication. |
| | Use Case: MissingLocalMeasurementDataWhenPredicting |
| ID | UC8 |
| Brief description | A vehicle attempts to gather vehicle state measurements through physical sensors in preparation for detecting future collisions, but the measurements are unavailable. No data is sent. |
| Primary actors | LocalVehicle |
| Pre-conditions | 1. Vehicles are within V-V communication range of one another.<br>2. Vehicles are both running ICA.<br>3. One or more vehicle sensors are unavailable. |
| Main flow | 1. LocalVehicle creates vehicle measurements and attempts to update their values from the physics sensors.<br>2. One or more sensors return no data.<br>3. Measurements are not stored and no collision avoidance can be done. LocalVehicle attempts to read the measurements again during the next application cycle. |
| | Use Case: MissingLocalMeasurementDataWhenSending |
| ID | UC9 |
| Brief description | A vehicle attempts to gather vehicle state measurements through physical sensors in preparation for broadcasting them to surrounding vehicles, but the measurements are unavailable. No data is sent. |
| Primary actors | LocalVehicle |
| Pre-conditions | 4. Vehicles are within V-V communication range of one another.<br>5. Vehicles are both running ICA.<br>6. One or more vehicle sensors are unavailable. |
| Main flow | 4. LocalVehicle creates vehicle measurements and attempts to update their values from the physics sensors.<br>5. One or more sensors return no data.<br>6. Measurements are not stored or broadcast. LocalVehicle attempts to read the measurements again during the next application cycle. |
| | Use Case: MissingRemoteData |
| ID | UC10 |
| Brief description | ICA attempts to compare the local vehicle and remote vehicle paths to look for future collisions, but the remote vehicle state was never received. No collisions are predicted. |
| Primary actors | LocalVehicle, RemoteVehicle |
| Pre-conditions | 1. Vehicles are within V-V communication range of one another.<br>2. Vehicles are both running ICA.<br>3. Remote vehicle data was not received. |
| Main flow | 1. RemoteVehicle begins listening for vehicle state information broadcast wirelessly.<br>2. Before any remote vehicle state is received, the application attempts to perform collision detection.<br>3. RemoteVehicle provides no data to the application, and the collision detection is aborted until the next application cycle. |
| | Use Case: ExpiredRemoteData |
| ID | UC11 |
| Brief description | ICA attempts to compare the local vehicle and remote vehicle paths to look for future collisions, but the remote vehicle state is either too old or was never received. No collisions are predicted. |
| Primary actors | LocalVehicle, RemoteVehicle |

TABLE 7-continued

| | |
|---|---|
| Pre-conditions | 1. Vehicles are within V-V communication range of one another.<br>2. Vehicles are both running ICA.<br>3. Remote vehicle data is expired. |
| Main flow | 1. RemoteVehicle begins listening for vehicle state information broadcast wirelessly.<br>2. Before any remote vehicle state is received, the application attempts to perform collision detection.<br>3. RemoteVehicle provides no data to the application, and the collision detection is aborted until the next application cycle. |

Table 8 provides a requirement traceability matrix used to check consistency of the requirement specification. If the specification of the requirements and the use cases are properly performed, there is at least one use case per functional requirement and vice versa. Stated differently, the functional requirements can be traced back from the use cases.

TABLE 8

| Requirement Traceability Matrix | | Use Cases | | | | | | | | | | |
|---|---|---|---|---|---|---|---|---|---|---|---|---|
| | | UC1 | UC2 | UC3 | UC4 | UC5 | UC6 | UC7 | UC8 | UC9 | UC10 | UC11 |
| Requirements | FR1 | • | • | • | • | • | • | • | • | • | • | • |
| | FR2 | — | • | • | • | • | — | — | — | — | — | — |
| | FR3 | — | — | — | — | • | — | — | — | — | — | — |
| | FR4 | — | • | • | • | • | — | — | — | — | — | — |
| | NFR1 | N/A | N/A | N/A | N/A | N/A | N/A | N/A | N/A | N/A | N/A | N/A |
| | NFR2 | N/A | N/A | N/A | N/A | N/A | N/A | N/A | N/A | N/A | N/A | N/A |
| | NFR3 | N/A | N/A | N/A | N/A | N/A | N/A | N/A | N/A | N/A | N/A | N/A |
| | NFR4 | N/A | N/A | N/A | N/A | N/A | N/A | N/A | N/A | N/A | N/A | N/A |
| | NFR5 | N/A | N/A | N/A | N/A | N/A | N/A | N/A | N/A | N/A | N/A | N/A |

The Application Layer, Vehicle Layer and Communication Layer with the various use cases afford for the ICA system to detect upcoming collisions between at least two vehicles approaching an intersection and control one or more of the vehicles to take evasive action in order to avoid the collision. For example, the microprocessor with the algorithm can load, or already have, data and/or information such as model parameters for the local vehicle, engine torque limits for the local vehicle and the like, and such information can be updated through the vehicle layer. Vehicle measurements can be retrieved for a given time and then updated at predetermined time intervals. If any measurement is unable to be read, the algorithm can set such a value as unusable and immediately return for an update.

Using the engine torque limits, longitudinal displacement and speed, a vehicle path can be calculated for a current time and predicted for a future time. The algorithm can store the displacement and speed data, and then initiate a collision detection calculation.

The collision detection calculation can include the calculation or construction of a capture set for current vehicle states and a capture set for predicted vehicle states. In addition, a collision zone of the intersection can be loaded and/or already stored within the microprocessor and whether or not the vehicle is within its capture set can be determined. If the vehicle is determined not to be within the capture set for its current vehicle states, whether or not the vehicle will enter the capture set for the next predicted state is determined. If the vehicle is predicted to be within the capture set for the next predicted state, then the algorithm determines whether the vehicle should brake, accelerate, or do nothing in order to avoid a collision with a remote vehicle traveling towards the intersection.

For example, the algorithm can instruct the controller to execute a torque value on the vehicle. If the torque value is positive, acceleration is required, whereas if the torque value is negative braking is required. In the event that the ICA system determines that both the local vehicle and at least one other remote vehicle are within the capture set, then any control will be insufficient to prevent both vehicles from entering the collision zone and a severe collision warning can be provided to the drivers of the vehicles.

The ICA system with the algorithm can also collect and prepare data to be transmitted to a remote vehicle using vehicle-to-vehicle wireless communication. The data can be sent at a frequency defined by the ICA system, for example every 100 milliseconds. It is appreciated that the data can include the vehicle state information for the local vehicle and once it has been transmitted and/or sent, such vehicle state information can be updated and transmitted again. In this manner, the latest vehicle state information for the local vehicle is transmitted out to remote vehicles.

It is appreciated that the remote vehicles can do the same, i.e. send its vehicle state information to the local vehicle. The ICA system can afford for receiving of remote data and use the remote data to update the construction and/or calculation of the capture set. In some instances, the ICA system interacts with the vehicle layer using the ICA local vehicle class. This class creates standard vehicle measurements to keep track of the vehicle state, can be the exclusive link to the communication layer, and can collect and store remote vehicle state information collected via vehicle-to-vehicle communication.

An ICA application class can be a central coordination point for all of the applications' functions. The ICA application class can manage updating and sending of local vehicle state information and can determine how often the ICA algorithm should be executed. For example, the ICA application class can revolve around an application thread that repeats a primary loop every 100 milliseconds. In some instances, the local vehicle state information can be updated twice per primary loop, once when executing the ICA algorithm, and once before broadcasting the vehicle state information over the communication layer. In this manner, the most up to date possible vehicle data can be used in every calculation.

ICA application classes related to gathering and manipulating of vehicle states can include an ICA vehicle abstract class, an ICA local vehicle class, an ICA remote vehicle class, and/or ICA remote vehicles class. The ICA vehicle abstract class can gather common functionality of the local and remote vehicles that run the ICA system and an ICA vehicle use case can be constructed from local vehicle measurements or from data received via vehicle-to-vehicle communication. The ICA algorithm can then access the vehicle state information of the two vehicles of interest exclusively by public methods of the ICA vehicle abstract class. It is appreciated that the ICA vehicle abstract class may or may not expose the source of the vehicle state information, such information being irrelevant when detecting collisions.

Examples of use cases within the ICA vehicle abstract class can include: getting engine torque limits; getting vehicle model parameters; getting an ID of each vehicle; getting the prescribed path of the vehicle; getting the current longitudinal displacement along the prescribed path; getting the longitudinal speed along the prescribed path; getting the predicted displacement of the vehicle on the prescribed path for a predetermined time period in the future; getting the predicted speed for the vehicle on the prescribed path for a predetermined time period in the future; updating the longitudinal displacement, speed, etc. for the vehicle; and determining if the last update of data was successful or not.

The ICA local vehicle class can determine the current vehicle state by creating and querying vehicle measurements. In addition, this class can manage the sending out of local vehicle data via the communication layer.

The ICA remote vehicle class can receive information from one or more remote vehicles and afford for the use of this data by the ICA algorithm.

The ICA algorithm can also have a number of classes, illustratively including an escape controller class, a capture set slice class, and the like. The escape controller class can run or execute the ICA algorithm on one or more vehicles in order to detect future collisions as discussed above, and if necessary, afford for control of the vehicles in order to avoid a collision. A use case within the escape controller class can obtain updated state information for both the local and remote vehicles, and a use case of calculation control can calculate and return the amount of torque needed to avoid a collision.

The capture set slice class can generate the capture set for two or more vehicles and a final capture set in order to determine if the current vehicle state is on a course for collision. It is appreciated that the capture set slice class can implement the ICA algorithm. The capture set slice class can also use the collision zone to determine if the local and remote vehicles are headed for a collision, the collision zone stored in a configuration file on both vehicles.

In some instances, if not all, the collision zone should match for both vehicles. In addition, the collision zone can be received via roadside infrastructure with or without a sanity check being performed in order to make sure both vehicles are operating with the same collision zone.

In another embodiment of the present invention, assumptions for the above disclosed embodiment(s) are relaxed and a more versatile system is provided. In particular, the following assumptions are not assumed to be accurate:

1. The vector field f(x, u) is known exactly;
2. The current state $\phi(t, x, u)$ is available on-board both vehicles, thereby implying control is always evaluated symmetrically;
3. Communication between both vehicles is non-interrupted and immediate; and
4. Both vehicles run the ICA system and can communicate with each other to cooperate in avoiding a collision.

These assumptions, or the lack thereof, are handled with the use of a disturbance model where the system definition tuple is given by $\Sigma=\{X, U, \Delta, f\}$ where the set defines the admissible disturbance inputs and $S(\Delta)$ defines a set of admissible disturbance signals. In addition, the vector field is extended to accept a disturbance input given by $f{\cdot}X\times U\times\Delta\rightarrow X$, which allows a disturbance to affect the evolution of the two vehicle system. The flow of the system, i.e. of the two vehicles, is also modified to include a disturbance input, given by $\varnothing: R_+\times X\times S(U)\times S(\Delta)-X$, which hereafter is denoted as $\phi(t, x, u, \delta)$ for the time $t\in R_+$, initial condition of $x\in X$, an input signal of $u\in S(U)$ and a disturbance signal of $\delta\in S(\Delta)$.

In addition to the above, the recursive method $S_i^h$ is redefined for calculating a current speed based on a speed at a previous time step and a current acceleration (see Equations 41 and 42) and is used to in back propagation to determine a distance the vehicle travels in one time step.

$$S_i^o(s_i,u_i)=s_i \tag{41}$$

$$S_i^h(s_i,u_i,\delta)=F(S_i^{h-1}(s_i,u_i,\delta),u_i,\delta;\Delta T,s_{min_i},s_{max_i}),\forall h\in 1,2, \tag{42}$$

In addition, the recursive method uses the following expressions with two methods defined for calculating a lower and upper bound of possible vehicle state sets at a previous time step. The first method is represented by Equations 43-46 and the second method represented by Equations 47-52. In particular, for each value of h a new frame in the set is calculated.

$$L_i^0 = L_i \tag{43}$$

$$L_i^h(s_i, u_i) = L_i - \sum_{j=0}^{h-1} S_i^j(s_i, u_i, \delta_H)\Delta T,\ \forall\ h \in 1, 2, \ldots \tag{44}$$

$$H_i^0 = H_i \tag{45}$$

$$H_i^h(s_i, u_i) = H_i - \sum_{j=0}^{h-1} S_i^j(s_i, u_i, \delta_H)\Delta T,\ \forall\ h \in 1, 2, \ldots \tag{46}$$

$$L_i^0 = L_i \tag{47}$$

$$L_i^h(s_i, u_i) = L_i^{h-1}(s_i, u_i) - S_i^{h-1}(s_i, u_i, \delta_H)\Delta T \tag{48}$$

$$(L_i^h, S_i^{h-1}) = f(L_i^{h-1}, S_i^{h-2}) \tag{49}$$

$$S_i^{h-1} = F(S_i^{h-2}, u_i, \delta_H) \tag{50}$$

$$L_i^h = L_i^{h-1} - S_i^{h-1}\Delta T \tag{51}$$

$$L_i^h(S_i(k)) = L_i^{h-1}(S_i(k+1)) - S_i(k)\Delta T \tag{52}$$

It is appreciated that for each step of calculating a bound, a previous bound as well as a previous bound recalculated with a current speed are required.

Given the presence of one or more disturbances, the capture set can be defined as the largest set such that given any input signal, there exists a disturbance signal and time such that the flow of the system enters the bad set B. This can be mathematically defined by:

$$C:=\{x\in X|\forall u\in S(U),\exists\delta\in S(\Delta),\text{ and }\exists t\in R_+\text{ such that }\phi(t,x,u,\delta)\in B\} \quad (53)$$

It is appreciated that the inclusion of one or more disturbances affords for the ability to treat a non-communicating vehicle, system identification errors, communication delays, and the like.

The embodiments disclosed above also assumed that the vector field f(x, u) was known within the computation of restricted capture sets. However, in some instances it can be desired to model the system as a nonlinear hybrid system composed of cascaded delay differential equations that can account for actuator delays and partial differential equations from combustion, timed discrete event systems that account for the use of a computer system, hybrid automata that accounts for transmission delays, and a parameter varying nonlinear mechanical system that accounts for vehicle dynamics. Such uncertainties can be extremely complex if not impossible to model, however the inventive ICA system disclosed herein accounts for such uncertainties by introducing disturbance inputs into the system.

Not being bound by theory, the ICA system can be correctly or adequately modeled with the consideration of the dynamics under the control of input signals $u_L$ and $u_H$ since the capture set can be computed as the intersection of two restricted capture sets under or within these inputs (e.g. see Equation 43). Furthermore, the inventive ICA system affords for a model that can be experimentally computed and loaded into vehicle configuration files within the processing unit.

Figure 12:
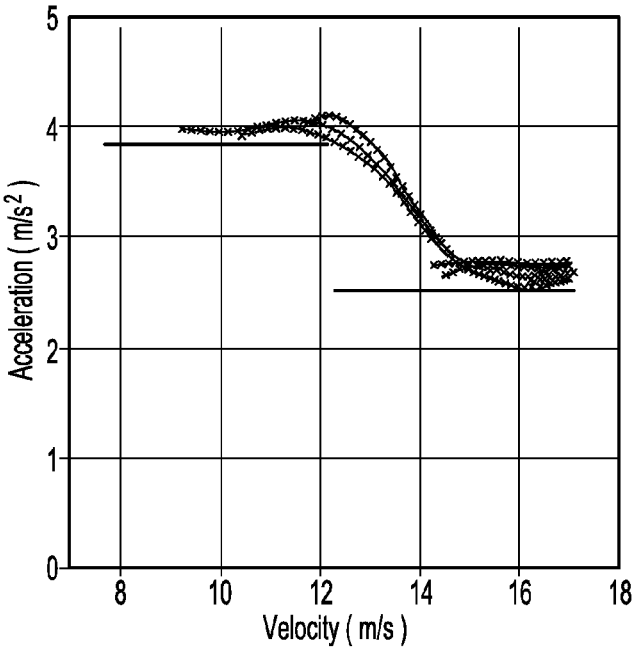
FIG. 12 is a graphical representation of acceleration versus velocity for a vehicle with a given input set.
Figure 13:
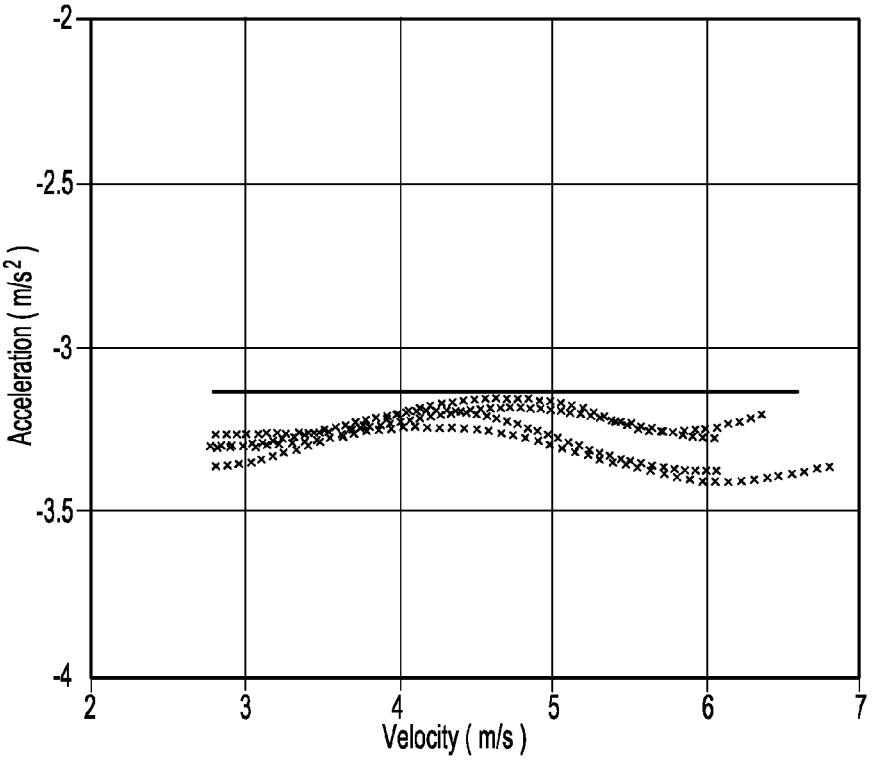
FIG. 13 is a graphical representation of de-acceleration versus velocity for a vehicle with a given input set.

Given a fixed input $\bar{u}\in U$, the order preserving properties of the ICA system allow modeling of the dynamics within the differential inclusion and taking into account disturbances as:

$$f(x,\bar{u})\in\bar{f}(x_2):=[f(x_2,\bar{u},\delta_L),f(x_2,\bar{u},\delta_H)] \quad (56)$$

where $x_2$ denotes velocity. It is appreciated that the dynamics $f(x, \bar{u}, \delta_L)$ and $f(x, \bar{u}, \delta_h)$ can be experimentally determined by taking or determining a set of data trials from various initial conditions and taking a worst case performance. For example and for illustrative purposes only, FIG. 12 provides a graphical representation in which the solid horizontal lines depict a vehicle's slowest acceleration as a function of velocity for a given input $u_H$ and FIG. 13 provides a graphical representation in which the solid line depicts the vehicle's slowest de-acceleration as a function of velocity for a given input $u_L$. By virtue of the order preserving properties of the vector field with respect to disturbance input and state, the upper and lower bounds of the bad set B can be integrated backwards under the upper and lower bounds of the differential inclusion $\bar{f}(x_2)$, using a slightly modified linear complexity algorithm to construct the capture set slice (42). Under (43), this capture set slice can be used to construct a capture set under or using the presence of disturbances. Thereafter, control can be applied in the same manner as the ICA system disclosed above.

Regarding the assumption that the current state is always known on-board for both vehicles, it is appreciated that communication between both vehicles and/or communication between a given vehicle and a roadside structure can introduce delays and the construction of the state $x\in X$ will be made using old information/data. However, the inventive ICA system incorporates this state uncertainty by assuming the current state is inside the interval set $\hat{x}(t)\subset X$, hereafter referred to as the current state uncertainty. As such, the model has $\phi(t, x, u, \delta)\in\hat{x}(t)$ for all $t\in R_+$.

With the above current state uncertainty accounted for, the dynamic control problem, i.e. the imperfect state, rather than a static control problem, i.e. perfect information, can be solved. In particular, a separation principle exists with respect to estimation and control and thus a control problem can be independent from an estimation problem. Thus, and similar to a case where perfect information is assumed, a safety control is identified and based on a capture set defined over all sets of initial conditions and the capture set C is defined as a set of sets of initial conditions $A\subset X$ such that given any input applied to the system, there exists an initial condition $x\in A$, disturbance $\delta\in S(\Delta)$ and a time $t\in R_+$ such that flow of the system enters the bad set B. Mathematically this is defined or given as:

$$C:=\{A\subset X|\forall u\in S(U),\exists x\in A,\exists\delta\in S(\Delta),\text{ and }\exists t\in R_+\text{ such that }\phi(t,x,u,\delta)\in B\} \quad (57)$$

which affords computation by back propagating the bad set B with input fixed under the differential inclusion generated by the set of disturbances. Stated differently, a restricted capture set for a fixed input can be computed by:

$$C_{\bar{u}}:=\{A\subset X|\exists x\in A,\exists\delta\in S(\Delta),\text{ and }\exists t\in R_+\text{ such that }\phi(t,x,\bar{u},\delta)\in B\} \quad (58)$$

and the capture set can be determined as:

$$C:=\{A\subset X|C_{u_L}\cap A\neq\phi\text{ and }C_{u_H}\cap A\neq\phi\} \quad (59)$$

Given the order preserving properties of the system dynamics with respect to input and disturbance, further affords for the construction of a linear complexity algorithm with respect to the state of the system in order to compute each restricted capture set $C_{\bar{u}}$. As such, a control map can be a set-valued map G:P(X)=U that accepts sets of arguments rather than only a given state. Furthermore, the control chosen can be the least restrictive and thereby guarantee a safety specification is met. In fact, a safety specification can be interpreted in terms of an escape set $\overline{W}\subset P(X)$, which is defined as a set of sets of initial conditions such that safety can be maintained with respect to the bad set B. Mathematically this can be given as:

$$A\subset\overline{W}\Rightarrow\phi(t,A,u_{GL},\delta)\cap B\neq\emptyset,\forall t\in R_+,\forall\delta\in S(\Delta) \quad (60)$$

where:

$$u_{cl}(\tau)\in G(\phi(t,A,u_{cL},\delta)) \quad (61)$$

Given that the dynamic control problem has been solved, the state estimation problem can also be solved to accommodate a communication delay. In particular, a remote vehicle information received by a local vehicle can be by the tuple ($x^r$, $t^r$, F(t)) where $x^r\in X^r$ is the remote vehicle dynamic state, $t^r$ is the time stamp for the universal time at which a message was sent and a set-valued signal of the future dynamics $F:R_+\rightarrow P(X)$, which is assumed to contain remote dynamics during a transmission time. Stated differently, $f(x^r(\tau), u^r(\tau))\in F(\tau)$ for all time $\tau\in[t^r, t]$. In addition, a current remote state uncertainty can be calculated as:

$$X^r=x^r+\int_{t^r}^{t}F(\tau)d\tau \quad (62)$$

where t is a current time for a local vehicle which is assumed to be greater than a remote time stamp $t_0^r$. As such, the following inclusion must always hold:

$$x^r(\tau)\in X^r(t) \quad (63)$$

It is appreciated that this can be the main source of state uncertainty for the ICA system.

In the event that one of the vehicles is a non-communicating vehicle, the non-communicating vehicle can be modeled with all inputs replaced with disturbances. Stated differently, the non-communicating vehicle is modeled as the tuple $$\sum^{2} \square = \{X^2, \Delta^2, f^2\},$$

where the vector field is of the form $f:X\times\Delta\rightarrow X$. It is appreciated that the safety specification introduced above must be interpreted as the set of all initial conditions such that for any input by the non-communicating vehicle, a control exists that maintains the safety specification. This can be accomplished by identifying a set escape set W and closed loop feedback $G:X\rightrightarrows U$ such that the safety specification is met and mathematically provided by:

$$x\epsilon W \Rightarrow \phi(t,x(u_{cl}^{l},\delta^2))\epsilon B, \forall t\epsilon R_+, \forall\delta^2\epsilon S(\Delta^2) \tag{64}$$

where:

$$u_{cl}^{l}(\tau)\epsilon G(\phi(t,x(u_{cl}^{l},\delta^2))) \tag{65}$$

It is appreciated that such an implementation is the same as the above-identified embodiments except that the input set is now given as $U=\{0\}$ for a non-communicating vehicle, or in the alternative is replaced by a disturbance signal.

Regarding algorithmic implementation, a summary of the algorithmic tools used to compute the restricted capture is provided. In particular, this is accomplished through a linear complexity algorithm, in terms of state dimension [3]. The algorithms are implemented on-board a vehicle computer and thus use a discrete-time system model to numerically integrate the dynamics. The discrete-time flow of this system is denoted as $\phi:\mathbb{N}\times X\times S(U)\times S(D)\rightarrow X$, with a step size $\Delta T>0$, and the discrete-time flow is generated by the forward Euler approximation of the continuous time dynamics which can be mathematically described by:

$$\phi(n+1,x,u,\delta)=\phi(n,x,u,\delta)+\Delta Tf(\phi(n,x,u,\delta),u[n-1],\delta[n-1] \tag{66}$$

With an initial condition of $\phi(0, x, u, \delta)=x$, and sampled signals $u[n]:=u(n\Delta T)$ and $\delta[n]:=\delta(n\Delta T)$.

Rather than explicitly computing the restricted capture set $C_u$, we compute a slice of the restricted capture set, denoted $\tilde{C}_u\subset X_1$, corresponding to the current vehicle velocity. Due to the order preserving properties of the dynamics with respect to state and input, and the structure of the bad set $B\subset X$ the restricted capture set slice is computed through back propagation of the upper and lower bounds of the bad set, i.e. L, $H\epsilon X_1$. Specifically, the algorithm CaptureSetSlice($\hat{x}$, u) uses the sequences L(m, x, u) and H(n, x, u), which are given by $$L(n,x,u):=L+x_1-\Phi_1(n,x,u,d_H),$$

$$U(n,x,u):=U+x_1-\Phi_1(n,x,u,d_L), \tag{67}$$

where $d_L(t):=(d_L^1,d_L^2)$ and $d_H(t):=(d_H^1,d_H^2)$ for all $t\epsilon\mathbb{R}_{\geq 0}$. The restricted capture set slice $C_u$ can be written as $$\tilde{C}_u = \bigcup_{k\in N} ]L(n, sup\hat{x}, u), H(n, inf\hat{x}, u)[. \tag{68}$$

Membership within the capture set slice can then be concluded by taking intersection of the state uncertainty with the collection of all interval sets, established by $$\hat{x}_1 \cap \bigcup_{k\in N} ]L(n, sup\hat{x}, u), H(n, inf\hat{x}, u)[ \neq \theta \Leftrightarrow \hat{x}_1 \cap \tilde{C}_u \neq \theta. \tag{69}$$

The input arguments of the function used to construct the restricted capture set slice are the state uncertainty $\hat{x}\subset X$ and the control signal $u\epsilon S(U)$. The output is the capture set slice $\tilde{C}_u$, computed with the Algorithm 3.6.

Algorithm 1 $\tilde{C}_u$ = CaptureSetSlice ($\hat{x}$, u)

```
Input: (x̂, u) ∈ 2^X × S (u)
n = 1
loop
  Termination met when the sequence H(n, inf x̂, u) is no longer in the set
  Cone+(inf x̂1).
  if inf x̂1 ≤ H(n, inf x̂, u) and inf x̂1 ∉ ]L(n, sup x̂, u), H(n, inf x̂, u)
    [ then n = n + 1
  else
    return C̃u = ∪k≥n]L(k, sup x̂, u), H(k, inf x̂, u)[.
  end if
end loop
Output: C̃u ⊂ X1.
```

If the state uncertainty $\hat{x}$ is an interval set, we can conclude non-empty intersection of the capture set with the state uncertainty by using the equivalence $$\hat{x}_1\cap\tilde{C}_u=\emptyset\Leftrightarrow\hat{x}\cap C_u=\emptyset. \tag{70}$$

The closed-loop implementation of the feedback set-valued map (12), in discrete time, is provided in Algorithm 3.6 from [3], where u=FeedbackMap($\hat{x}$[n+1], $\hat{x}$[n]).

Algorithm 2 u = FeedbackMap($\hat{x}$ [n + 1], $\hat{x}$ [n])

```
Input: (x̂ [n + 1], x̂ [n]) ∈ 2^X × 2^X
Construct capture set slices for state prediction.
C̃uL = CaptureSetSlice(x̂[n + 1], uL), C̃uH = CaptureSetSlice(x̂[n + 1], uH)
Check if predicted state x̂ [n + 1] intersects both capture set slices.
if x̂ [n + 1] ∩ C̃uL ≠ ∅and x̂ [n + 1] ∩ C̃uH ≠ ∅then
  Construct capture set slices for current state.
  C̃uL = CaptureSetSlice(x̂ [n], uL), C̃uH = CaptureSetSlice(x̂ [n], uH)
  Determine control according to equation (27).
  if x̂1[n] ∩ C̃uL = ∅and x̂1[n] ∩ C̃uH ≠ ∅then
    u = uL
  else if x̂1[n] ∩ C̃uL ≠ ∅and x̂1[n] ∩ C̃uH = ∅then
    u = uH
  else
    u = uL
  end if
else
    No control specified.
    u ∈ U
end if
Output: u ∈ U.
```

The invention is not restricted to the embodiments, illustrative examples, and the like described above. The embodiments, examples, etc. are not intended as limitations on the scope of the invention. Methods, processes, systems, and the like described herein are exemplary and not intended as limitations on the scope of the invention. Changes therein and other uses will occur to those skilled in the art. The scope of the invention is defined by the scope of the claims.

We claim:

1. A back propagating intersection collision avoidance system for preventing two vehicles from colliding at an intersection, said system comprising:

a first vehicle and a second vehicle, said first and second vehicle each operable to approach the intersection at a definable velocity and acceleration, said intersection having a collision zone in which said first and second vehicle will collide if present at a same time;

said first vehicle having a processing unit with controller and a microprocessor with an algorithm, said algorithm having a disturbance model and said processing unit operable to back propagate from said collision zone a capture set as a function of a disturbance for said first and second vehicle, determine if said first and second vehicle is within said capture set, and if not, determine if said first and second vehicle will enter said capture set, said capture set covering control scenarios as a function of maximum torque and minimum torque of said first vehicle;

said processing unit also operable to instruct said controller to accelerate or de-accelerate said first vehicle in order to prevent said first vehicle from entering said capture set.

2. The system of claim 1, wherein said processing unit with said disturbance model is operable to calculate said disturbance as a function of uncertainty from at least one of: actuator delays for said first vehicle; actuator delays for said second vehicle; discrete time steps used by said microprocessor and said algorithm; communication time delays; vehicle dynamics for said first vehicle; and vehicle dynamics for said second vehicle.

3. The system of claim 2, wherein said processing unit with said disturbance model is operable to calculate a worst case scenario for at least one of said first vehicle and said second vehicle.

4. The system of claim 3, wherein said processing unit with said disturbance model is operable to calculate a disturbance as a function of at least one of: current dynamics of said first vehicle not known entirely; current dynamics of said second vehicle not known entirely; a current state of said first and second vehicle not known due to a communication delay; a current state of said first and second vehicle not known due to at least one sensor noise; and a current state of said second vehicle not known due to said second vehicle being a non-communicating vehicle.

5. The system of claim 4, wherein said processing unit with said disturbance model is operable to calculate said second vehicle as a complete disturbance when said second vehicle is a non-communicating vehicle.

6. The system of claim 1, wherein said processing unit with said disturbance model is operable to calculate said capture set as a function of a disturbance signal and a time.

7. The system of claim 6, wherein said capture set (C) is:

$$C:=\{x\epsilon X|\forall u\epsilon S(U),\exists\delta\epsilon S(\Delta),\text{ and }\exists t>0\text{ such that }\phi(t,x,u,\delta)\epsilon B\}$$

where x is a distance, X is all possible x, u is an input signal, S(U) is the set of all causal input signals, t is time, $\phi$ is the current state, $\delta$ is a disturbance signal, $S(\Delta)$ is the set of all admissible disturbance signals and B is a bad set, said capture set (C) being a largest set such that given any input signal u, there exists a disturbance signal $\phi$ and time t such that the flow of the system enters the bad set B.

* * * * *